US006703177B2

(12) United States Patent
Yamazaki et al.

(10) Patent No.: US 6,703,177 B2
(45) Date of Patent: Mar. 9, 2004

(54) IMAGE FORMING METHOD USING A TONER FOR DEVELOPING A STATIC IMAGE

(75) Inventors: Hiroshi Yamazaki, Hachioji (JP); Ken Ohmura, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/126,156

(22) Filed: Apr. 19, 2002

(65) Prior Publication Data

US 2003/0036013 A1 Feb. 20, 2003

(30) Foreign Application Priority Data

Apr. 26, 2001 (JP) ..... 2001-129285

(51) Int. Cl.[7] ..... G03G 15/16
(52) U.S. Cl. ..... 430/124; 430/110.4; 430/126
(58) Field of Search ..... 430/124, 110.4, 430/126

(56) References Cited

U.S. PATENT DOCUMENTS

| | | | | |
|---|---|---|---|---|
| 5,329,342 A | | 7/1994 | Shirai et al. | 355/285 |
| 5,830,617 A | * | 11/1998 | Koyama et al. | 430/109 |
| 6,051,350 A | | 4/2000 | Inaba et al. | 430/45 |
| 6,248,494 B1 | * | 6/2001 | Yamazaki et al. | 430/110 |
| 6,296,980 B1 | * | 10/2001 | Oshiba et al. | 430/111 |
| 6,440,630 B2 | * | 8/2002 | Isobe et al. | 430/124 |
| 6,472,117 B1 | | 10/2002 | Kohyama et al. | 430/110.3 |
| 6,497,984 B2 | * | 12/2002 | Itami et al. | 430/125 |
| 2001/0004426 A1 | | 6/2001 | Sato | 399/350 |
| 2003/0031481 A1 | | 2/2003 | Miho | 399/222 |

FOREIGN PATENT DOCUMENTS

| | | |
|---|---|---|
| JP | 2000-172004 | 6/2000 |
| JP | 2000/214629 | 8/2000 |
| JP | 2000-250259 | 9/2000 |
| JP | 2001-265145 | 9/2001 |
| JP | 2001-296694 | 10/2001 |

* cited by examiner

*Primary Examiner*—John Goodrow
(74) *Attorney, Agent, or Firm*—Squire, Sanders & Dempsey

(57) ABSTRACT

An electrophotographic image forming method is disclosed. The method comprises forming a latent image on a static image carrier, developing the static image by a developer containing a toner, transferring the toner image onto another image carrier, transferring the toner image on the image carrier onto an image forming support, and fixing the toner image transferred on the image forming support, and the toner has a variation coefficient of the shape coefficient of not more than 16% and a number variation coefficient of the particle diameter distribution in number of not more than 27%, and the other image carrier is a cylindrical member having an electrode contacting to the interior surface thereof.

28 Claims, 12 Drawing Sheets

FIG. 10 ( a )
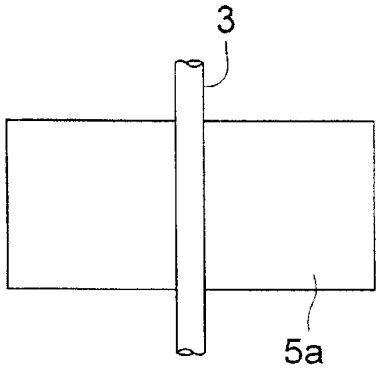
FIG. 10 ( b )
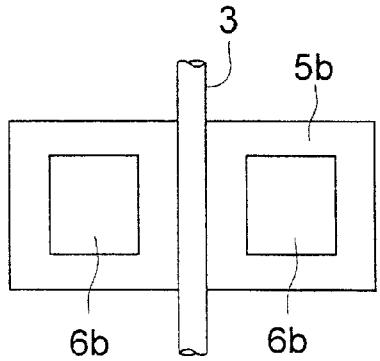
FIG. 10 ( c )
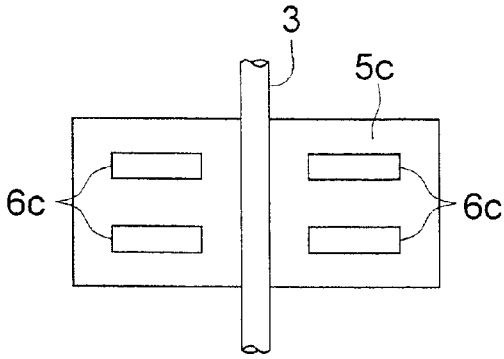
FIG. 10 ( d )
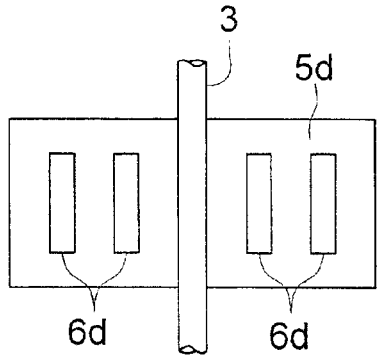

FIG. 11 ( a )
TONER HAVING NO CORNERS
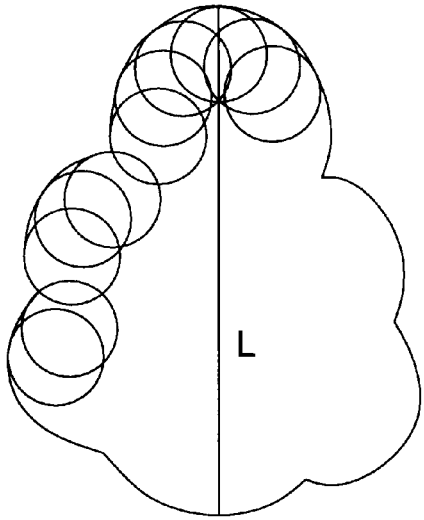
FIG. 11 ( b )
TONER HAVING CORNERS
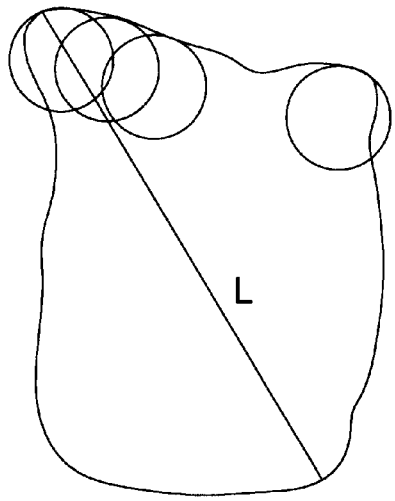
FIG. 11 ( c )
TONER HAVING CORNERS
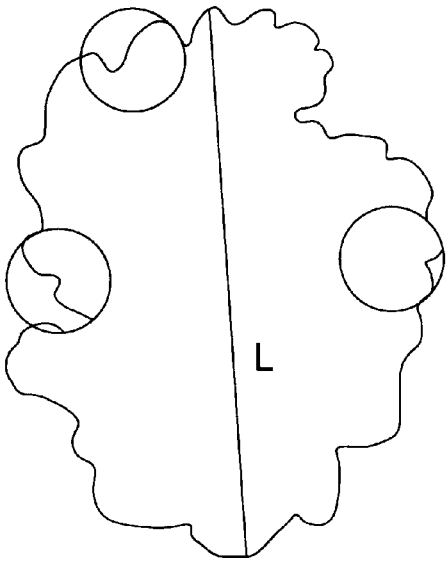

IMAGE FORMING METHOD USING A TONER FOR DEVELOPING A STATIC IMAGE

FIELD OF THE INVENTION

This invention relates to an image forming method using a toner for developing a static image.

BACKGROUND OF THE INVENTION

A method for forming a color image has been known by which a latent image formed on a static latent image carrier is developed by a toner, and the toner image is once transferred on an intermediate transfer member, not directly transferred onto an image forming support, and then transferred onto the image forming support and fixed. In such the method, a toner having a stable charging property is necessary since the toner image is subjected to plural times of transfer.

A usual toner produced by a pulverizing method causes a problem such that the color reproducibility of the color image is degraded since a component dispersed in the toner particle exists not uniformly on the broken surface of the particle, consequently the surface properties of the toner particles are difficultly made uniform and unevenness of the transferring behavior of each the particles is tend to be occurred.

In the process of the transferring to the intermediate transfer member, the disarrangement of the image caused by the transfer becomes as a large problem for disturbing the enhancement of quality of the image. Namely, the disarrangement of the image is occurred accompanied with the times of the transfer so that the high quality of the image is difficultly maintained.

Besides, a polymerized toner produced by a polymerization method has been known. A high uniformity of the toner particles can be expected as to a toner formed by a suspension polymerization method since the toner particles each have a sphere-shape and uniform surface properties. However, sphere-shaped particle causes a problem that the transfer ability is degraded since the adhesiveness to the static latent image carrier is made too high.

A toner for developing a static image and an image forming method using the toner is required, by which images can be stably obtained during a prolonged period.

SUMMARY OF THE INVENTION

The object of the invention is to provide an image forming method using the toner by which images can be stably obtained during a prolonged period.

1. An image forming method comprising the steps of forming a latent image on a static image carrier, developing the static image by a developer containing a toner, transferring the toner image onto another image carrier, transferring toner image on the image carrier onto an image forming support, and fixing the toner image transferred on the image forming support, wherein, the toner contains a resin and a colorant and the toner has a variation coefficient of the shape coefficient of not more than 16% and a number variation coefficient of the particle diameter distribution in number of not more than 27%, and the other image carrier is a cylindrical member having an electrode contacting to the interior surface thereof.

2. An image forming method comprising the steps of forming a latent image on a static image carrier, developing the static image by a developer containing a toner, transferring the toner image onto another image carrier, transferring toner image on the image carrier onto an image forming support, and fixing the toner image transferred on the image forming support, wherein, the toner contains a resin and a colorant and the toner has a content of particles without corner of not less than 50% and a number variation coefficient of the particle diameter distribution in number of not more than 27%, and the other image carrier is a cylindrical member having an electrode contacting to the interior surface thereof.

3. An image forming method comprising the steps of forming a latent image on a static image carrier, developing the static image by a developer containing a toner, transferring the toner image onto another image carrier, transferring toner image on the image carrier onto an imageforming support, and fixing the toner image transferred on the image forming support, wherein, the toner contains a resin and a colorant and the toner has a ratio of toner particles each having a shape coefficient of from 1.2 to 1.6 of not less than 65% in number and a variation coefficient of the shape coefficient of not more than 16%, and the other image carrier is a cylindrical member having an electrode contacting to the interior surface thereof.

4. An image forming method in which an image formed on an image carrier is transferred onto another image carrier or an image forming support, and at least one of the image carriers is an intermediate transfer member on which plural images each individually formed by developing a latent image formed on an individual latent image carrier by a developer containing a toner are transferred, and then the transferred images are again transferred onto the other image carrier of the image forming support, wherein the toner contains a resin and a colorant and the toner has a variation coefficient of the shape coefficient of not more than 16% and a number variation coefficient of the particle diameter distribution in number of not more than 27%.

5. An image forming method in which an image formed on an image carrier is transferred onto another image carrier or an image forming support, and at least one of the image carriers is an intermediate transfer member on which plural images each individually formed by developing a latent image formed on an individual latent image carrier by a developer containing a toner are transferred, and then the transferred images are again transferred onto the other image carrier of the image forming support, wherein the toner contains a resin and a colorant and the toner has a content of particles without corner of not less than 50% and a number variation coefficient of the particle diameter distribution in number of not more than 27%.

6. An image forming method in which an image formed on an image carrier is transferred onto another image carrier or an image forming support, and at least one of the image carriers is an intermediate transfer member on which plural images each individually formed by developing a latent image a latent image formed on an individual latent image carrier by a developer containing a toner are transferred, and then the transferred images are again transferred onto the other image carrier of the image forming support, wherein the toner contains a resin and a colorant and the toner has a ratio of toner particles each having a shape coefficient of from 1.2 to 1.6 of not less than 65% in number and a variation coefficient of the shape coefficient of not more than 16%.

BRIEF DESCRIPTION OF THE DRAWING

FIG. 10 is a schematic view showing a specific example of the shape of a stirring blade.

FIG. 11(*a*) is an explanatory view showing a projection image of toner particle having no corners. FIGS. 11(*b*) and 11(*c*) are explanatory views showing projection images of toner particles having corners.

DETAILED DESCRIPTION OF THE INVENTION

Figure 1:
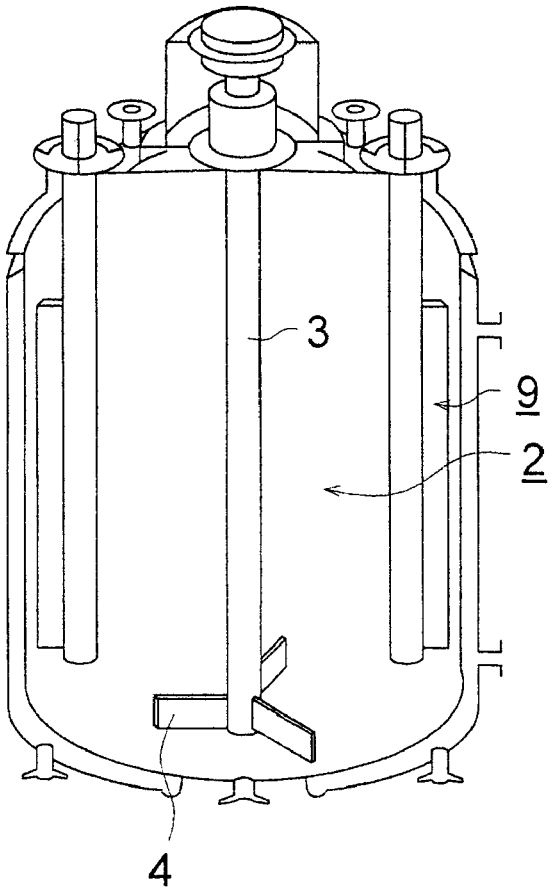
FIG. 1 is a view explaining a reaction apparatus having one level configuration of the stirring blade.

It has been found by the inventors that the image formation can be stabilized by controlling the physical parameters of the toner particle to the following specified values even in a method using an intermediate transfer member.

Moreover, it has been found that the image quality can be further enhanced by forming plural images each on plural intermediate transfer members and transferring the images onto an image forming support.

The toner for developing a static image to be used in the invention or toner of the invention is described below.

The variation coefficient of the shape coefficient of the toner is preferably not more than 16 percent, and number variation coefficient in the number particle distribution of the toner is preferably not more than 27 percent.

The toner has the number ratio of toner particles having no corners is preferably 50 percent and the number variation coefficient in the number size distribution is preferably adjusted to not more than 27 percent.

The toner preferably employed in the present invention has a number ratio of toner particles having a shape coefficient of 1.2 to 1.6 and is at least 65 percent, and further the variation coefficient of said shape coefficient is not more than 16 percent.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

In one of the embodiment of the invention the toner preferably has a number ratio of toner particles having a shape coefficient of 1.0 to 1.6 and is at least 65 percent, and more preferably 70 percent or more, and further number ratio of toner particles having a shape coefficient of 1.2 to 1.6 and is at least 65 percent, and particularly preferably 70 percent or more.

According to such characteristics as shape coefficient and number ratio of toner particles high toner filling density in a toner layer which is transferred to an intermediate transfer material is obtained, fluctuation of transfer characteristics of toner between different colors at the second image transfer process to an image forming support is reduced, and therefore, a good transfer characteristics is obtained. Further variation of adhesion property in each color is lowered and therefore a color image can be obtained stably since the toner particle is not easily crashed, stain on the charging member is reduced and charging characteristics of the toner becomes stable.

The polymerized toner of the present invention is that the number ratio of toner particles in the range of said shape coefficient of 1.2 to 1.6 is preferably at least 65 percent and is more preferably at least 70 percent.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

The toner obtained by polymerization method is preferable in view of simple preparation and excellent in uniform surface property comparing with the pulverized toner.

The variation coefficient of the polymerized toner is calculated using the formula described below:

$$\text{Variation coefficient}=(S/K)\times 100\ (\text{in percent})$$

wherein S represents the standard deviation of the shape coefficient of 100 toner particles and K represents the average of said shape coefficient.

The variation coefficient is preferably not more than 16%, and more preferably not more than 14% in the present invention. Gaps between toner particles in the toner layer are reduced, the transfer characteristics is minimized at the second transfer to the image forming support and therefore good image transfer characteristics is obtained. Further image characteristics is improved because sharp charging distribution is obtained.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by TOA MEDICAL ELECTRONICS CO., LTD.) Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

Number Variation Coefficient

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution. The number variation coefficient in the number particle distribution of toner is calculated employing the formula described below:

$$\text{Number variation coefficient}=(S2/D_n)\times 100 \text{ (in percent)}$$

wherein S2 represents the standard deviation in the number particle size distribution and $D_n$ represents the number average particle diameter (in $\mu$m).

The number variation coefficient of the toner of the present invention is not more than, preferably, 27 percent, and is more preferably not more than 25 percent. By adjusting the number variation coefficient to not more than 27 percent, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

The number ratio of toner particles having no corners is set preferably at least 50 percent, and or more preferably at least 70 percent. By adjusting the number ratio of toner particles having no corner as above, voids of the transferred toner layer decrease to improve transfer efficiency at the second transfer to the image forming support and therefore good image transfer characteristics is obtained. Further, the width of the charge amount distribution is narrowed and image quality is enhanced due to an increase in transfer efficiency since number of toners which are prone to be wore or crashed and have charge concentration portions reduces.

The toner particles of the present invention, which substantially have no corners, as described herein, mean those having no projection to which charges are concentrated or which tend to be worn down by stress. Namely, as shown in FIG. 11(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 11(*b*) and 11(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

In the invention, the color reproducibility is enhanced when the toner particles are uniform in the shape thereof in each of the yellow, magenta, cyan and black toners. Accordingly, it is preferable that the toners satisfy the following conditions.

Formula 1

$$0 \leqq R1 \leqq 0.2$$

wherein R1={(The maximum value of Ky, Km, Kc and Kb)−(The minimum value of Ky, Km, Kc and Kb)}/(The maximum value of Ky, Km, Kc and Kb)

Formula 2

$$0 \leqq R2 \leqq 0.30$$

wherein R2={(The maximum value of Kσy through Kσb)−(The minimum value of Kσy through Kσb)}/(The maximum value of Kσy through Kσb)

Formula 3

$$0 \leqq R3 \leqq 0.15$$

wherein R3={(The maximum value of Kσy through Kσb)−(The minimum value of Dy through Db)}/(The maximum value of Dy through Db)

Formula 4

$$0 \leqq R4 \leqq 0.30$$

wherein R4={(The maximum value of Dσy through Dσb)−(The minimum value of Dσy through Dσb)}/(The maximum value of Dσy through Dσb)

When the relations of the shape coefficient Ky, the variation coefficient of the shape coefficient Kσy, the number average of diameter Dy and the number variation coefficient of the number distribution of diameter Dσy of the yellow toner, the shape coefficient Km, the variation coefficient of the shape coefficient Kσm, the number average of diameter Dm and the number variation coefficient of the number distribution of diameter Dσm of the magenta toner, the shape coefficient Kc, the variation coefficient of the shape coefficient Kσc, the number average of diameter Dc and the number variation coefficient of the number distribution of diameter Dσc of the cyan toner, and the shape coefficient Kb, the variation coefficient of the shape coefficient Kσb, the number average of diameter Db and the number variation coefficient of the number distribution of diameter Dσb of the black toner, are represented by the formulas 1 through 4, the image forming method can be provided in which a good transferring ability can be held even when the transfer to the image forming support is performed through the intermediate transfer process.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

Diameter of Toner Particles

The diameter of the toner particles of the present invention is preferably between 3 and 8 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 μm, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in μm). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

<Comparing with a conventional toner>

The toner according to the invention can be clearly distinguished from the know toner as to (a) the ratio of the toner particles having a shape coefficient within the range of from 1.2 to 1.6 (not less than 65% in number in the toner of the invention), (b) the variation coefficient of the shape coefficient (not more than 16% in the toner of the invention), (c) the ratio of the particles having no corner (not less than 50% in number in the toner of the invention), and (d) the number variation coefficient of the particle diameter distribution in number (not more than 27% in the toner of the invention).

The values described in (a) to (d), regarding the toner according to the invention, of the usually known toners are described below. The values are different accompanied with the producing method of the toner.

(Toner by pulverizing method)

In the case of the usually known toner produced by a pulverizing method, the ratio of the particles having a shape coefficient within the range of from 1.2 to 1.6 is approximately 60% in number. The variation coefficient of the shape coefficient of such the toner is about 20%. In the toner by the pulverizing method, the ratio of the toner particles having no corner is not more than 30% in number since the particle size is made small by repeating the crushing accordingly the corner is formed on many toner particles. Therefore, a treatment for making sphere the shape of the toner particle by heating is necessary for controlling the shape coefficient to obtain atoner particles each uniformly has a rounded shape without corner. The number variation coefficient of the particle diameter distribution in number is about 30% when the classifying after crushing is performed only once. The classifying operation has to be repeated to obtain the number variation coefficient of not more than 27%.

(Toner produced by the suspension polymerization method)

Toner particles each having a true sphere shape can be obtained since the polymerization is performed in a layer flowing. For example, the ratio of the particles having a shape coefficient within the range of from 1.2 to 1.6 is approximately 20% in number, the variation coefficient of the shape coefficient is about 18%, and the ratio of the particle having no corner is about 85% in number in the toner described in Japanese Patent Publication Open to Public Inspection, hereinafter referred to as JP O.P.I., No. 63-186253. In the production process of the toner, large oil drop of the polymerizable monomer is make small to the size of the toner particle by repeating the mechanical tearing. Therefore, the distribution of the oil drop size is spread and the variation coefficient of number is as large as about 32%, and the classifying process is necessary to lower the variation coefficient of number.

In the polymerization toner produced by association or melt-adhesion of the resin particles, for example, the toner described in JP O.P.I. No. 63-186253, the ratio of the particles having a shape coefficient within the range of from 1.2 to 1.6 is approximately 60% in number, the variation coefficient of the shape coefficient is about 18%, and the ratio of the particle having no corner is about 44% in number. The distribution of diameter is wide and the variation coefficient of number is 30%. A classifying process is necessary to lower the variation coefficient of number.

Preparation of Toner

The toner preferably employed in the invention is one obtained by polymerization of at least polymerizable monomer in an aqueous medium and by coagulation of at least resin particle in an aqueous medium. Examples of the method to prepare the toner will be described.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

An example of preparation method of the toner particles is described. Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating . . . After completing the reaction, the dispersion stabilizers are removed, filtered, washed, and subsequently dried. In this manner, the toner of the present invention is prepared.

The water based medium as described in the present invention means one in which at least 50 percent, by weight of water, is incorporated. A method for preparing said toner may inekides include one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, c-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itacomic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

The coagulants employed in the present invention are preferably selected from metallic salts. Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc. Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application.

The coagulant is preferably added not less than the critical coagulation concentration. The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ξ potential of the dispersion, and in addition the critical coagulation concentration may be obtained as the salt concentration which initiates a variation in the ξ potential.

The concentration of coagulant may be not less than the critical coagulation concentration. However, the amount of the added coagulant is preferably at least 1.2 times of the critical coagulation concentration, and more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

In order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48 : 1, the same 53 : 1, the same 57 : 1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15 : 3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like. Example of the ester type wax includes carnauba wax, candelilla wax and microcrystalline wax.

The most preferable one is an ester represented by the following formula.

$$R^1—(OCO—R^2)_n$$

In the Formula (1) n is an integer of 1 to 4, preferably 2 to 4, more preferably 3 or 4, in particular preferably 4. $R^1$ and $R^2$ each represent a hydrocarbon group which may have a substituent. Said hydrocarbon group $R^1$ generally has from 1 to 40 carbon atoms, preferably has from 1 to 20 carbon atoms, and more preferably has from 2 to 5 carbon atoms.

Said hydrocarbon group $R^2$ generally has from 1 to 40 carbon atoms, preferably has from 16 to 30 carbon atoms, and more preferably has from 18 to 26 carbon atoms.

Examples of the ester wax are listed.

1) $CH_3—(CH_2)_{12}—COO—(CH_2)_{17}—CH_3$

2) $CH_3—(CH_2)_{18}—COO—(CH_2)_{17}—CH_3$

3) $CH_3—(CH_2)_{20}—COO—(CH_2)_{21}—CH_3$

4) $CH_3—(CH_2)_{14}—COO—(CH_2)_{19}—CH_3$

5) $CH_3—(CH_2)_{20}—COO—(CH_2)_6—O—CO—(CH_2)_{20}—CH_3$

6) $CH_3—(CH_2)_{20}—COO—(CH_2)_2—CH(CH_3)—CH_2—O—CO—(CH_2)_{20}—CH_3$

7) $CH_3—(CH_2)_{22}—COO—(CH_2)_2—CH(CH_3)—CH_2—O—CO—(CH_2)_{22}—CH_3$

-continued

8)

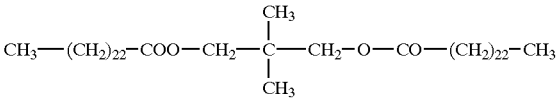

9)

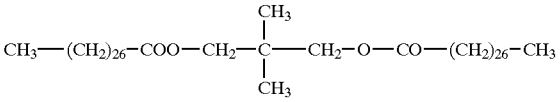

10)

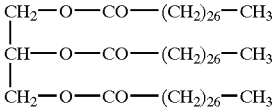

11)

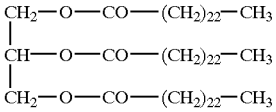

12)

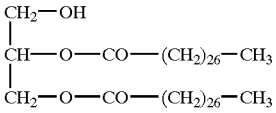

13)

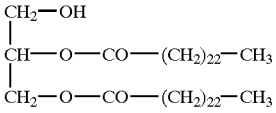

14)

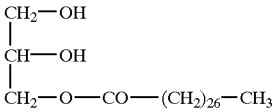

15)

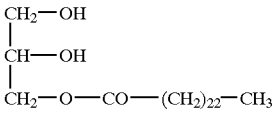

16)

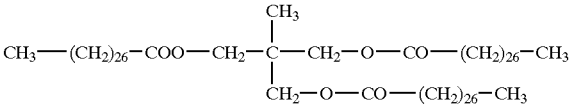

17)

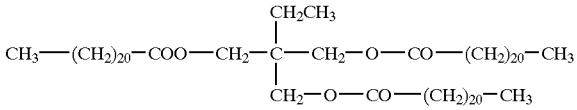

18)

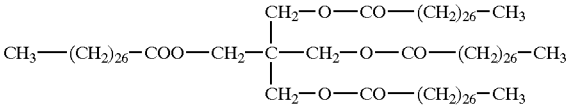

19)

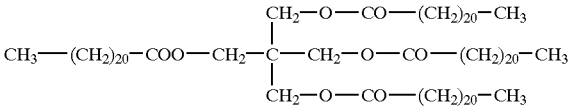

-continued

20)

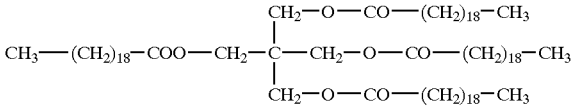

21)

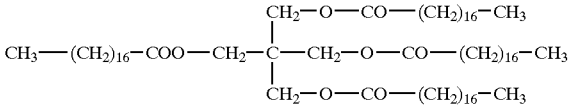

22)

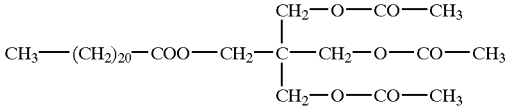

The content ratio of releasing agents in the toner is commonly 1 to 30 percent by weight, is preferably 2 to 20 percent by weight, and is more preferably 3 to 15 percent by weight.

The toner of the invention is prepared preferably by such a way that a monomer dissolving a releasing agent is dispersed in water and is polymerized to form particles in which the releasing agent is incorporated, and the particles are subjected to salting out/fusion as well as colored particles.

The releasing agent is incorporated in the toner particle in such a way that the releasing agent and the resin particles are subjected to salting out/fusing as well as colored particles, or the releasing agent is dissolved in a monomer to form resin particles and then the monomer is polymerized.

Employed as charge control agents may also be various types of those which are known in the art and can be dispersed in water. Specifically listed are nigrosine dyes, metal salts of naphthenic acid or higher fatty acids, alkoxylated amines, quaternary ammonium salts, azo based metal complexes, salicylic acid metal salts or metal complexes thereof.

It is preferable that the number average primary particle diameter of particles of said charge control agents as well as said fixability improving agents is adjusted to about 10 to about 500 nm in the dispersed state.

The toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

Preparation Apparatus

FIG. 1 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 1, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 2:
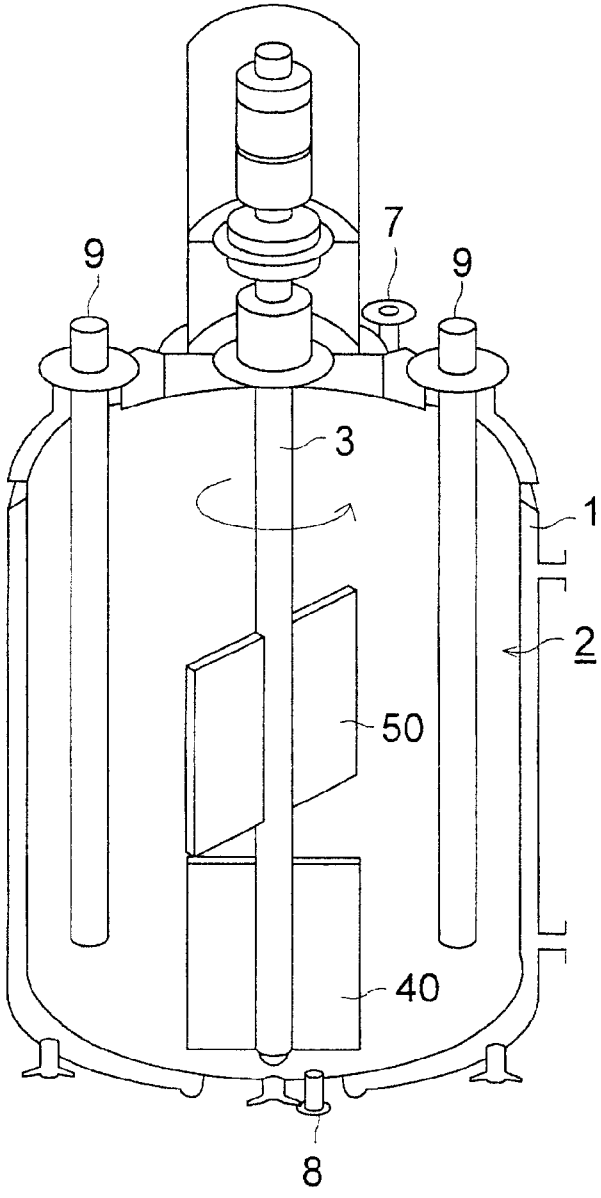
FIG. 2 is a perspective view showing one example of a reaction apparatus which is provided with preferably employable stirring blades.
Figure 3:
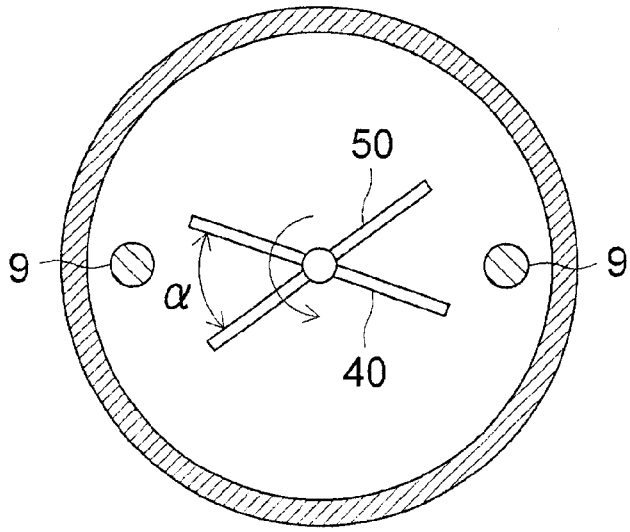
FIG. 3 is a cross-sectional view of the reaction apparatus shown in FIG. 2.

FIGS. 2 and 3 are a perspective view and a cross-sectional view, of the reaction apparatus described above, respectively. In the reaction apparatus illustrated in FIGS. 4 and 5, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 40 and upper level stirring blade 50. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

In FIGS. 2 and 3, arrows show the rotation direction, reference numeral 7 is upper material charging inlet, 8 is a lower material charging inlet, and 9 is a turbulent flow forming member which makes stirring more effective.

Herein, the shape of the stirring blades is not particularly limited, but employed may be those which are in square plate shape, blades in which a part of them is cut off, blades having at least one opening in the central area, having a so-called slit, and the like. FIGS. 10(*a*) to 12(*d*) describes specific examples of the shape of said blades. Stirring blade 5*a* shown in FIG. 10(*a*) has no central opening; stirring blade 5*b* shown in FIG. 10(*b*) has large central opening areas 6*b;* stirring blade 5*c* shown in FIG. 10(*c*) has rectangular openings 6*c* (slits); and stirring blade 5*d* shown in FIG. 10(*d*) has oblong openings 6*d* shown in FIG. 10(*d*). Further, when stirring blades of a three-level configuration are installed, openings which are formed at the upper level stirring blade and the openings which are installed in the lower level may be different or the same.

FIGS. 4 through 8 each show a perspective view of a specific example of a reaction apparatus equipped with stirring blades which may be preferably employed. In FIGS. 4 through 8, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 4:
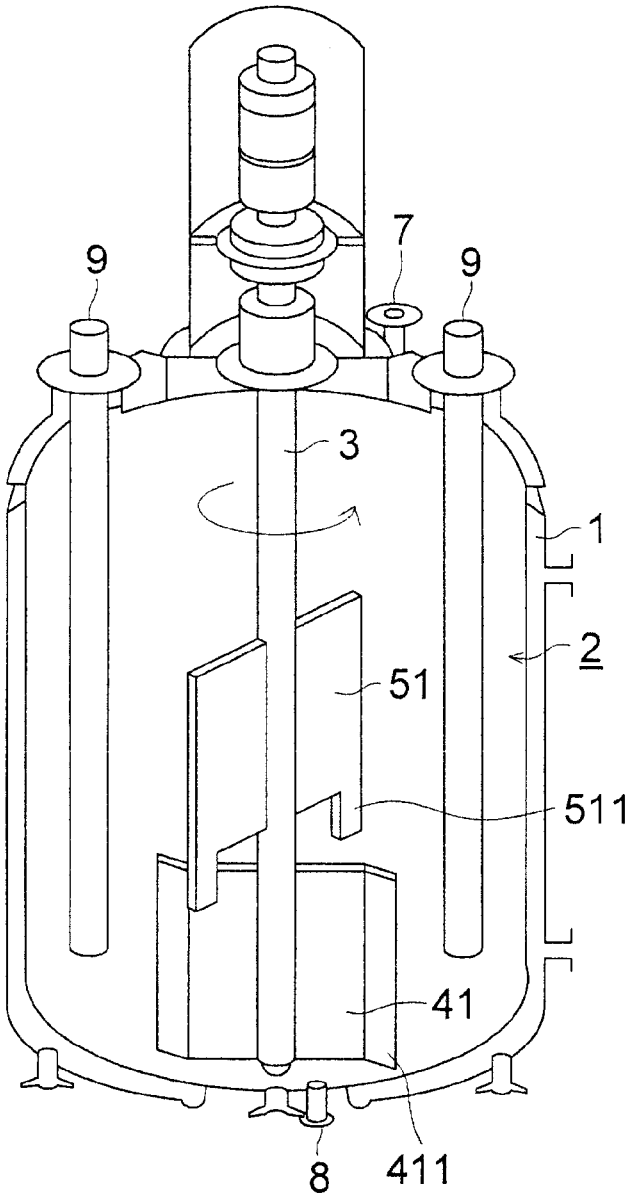
FIG. 4 is a perspective view showing a specific example of a reaction apparatus provided with the preferably employable stirring blades.

In the reaction apparatus shown in FIG. 4, folded parts 411 are formed on stirring blade 42 and fins 511 (projections) are formed on stirring blade 51.

Further, when said folded sections are formed, the folded angle is preferably between 5 and 45 degrees.

Figure 5:
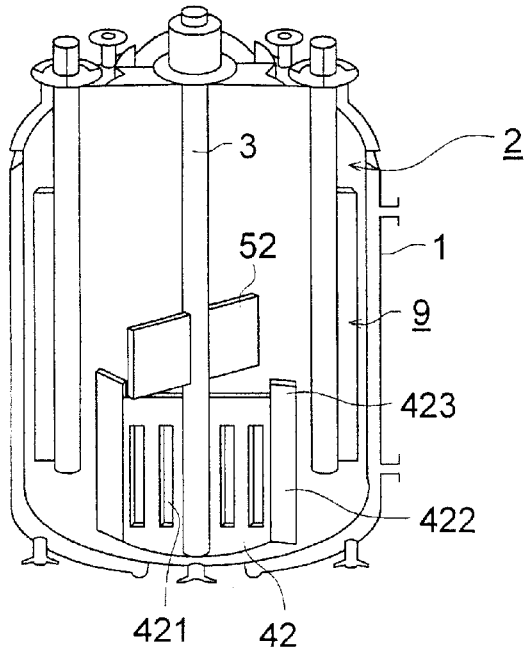
FIG. 5 is a perspective view showing a specific example of a reaction apparatus provided with the preferably employable stirring blades.

In stirring blade 42 which constitutes the reaction apparatus shown in FIG. 5, slits 142, folded sections 422, and fins 423 are formed simultaneously.

Further, stirring blade 52, which constitute part of the reaction apparatus, has the same shape as stirring blade 50 which constitutes part of the reaction apparatus shown in FIG. 2.

Figure 6:
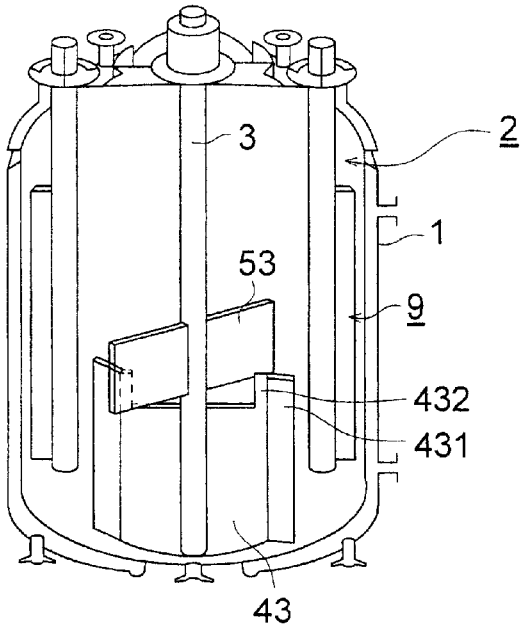
FIG. 6 is a perspective view showing a specific example of a reaction apparatus provided with the preferably employable stirring blades.

In stirring blade 43 which constitutes part of the reaction apparatus shown in FIG. 6, folded section 431 as well as fin 432 is formed.

Further, stirring blade 53, which constitutes part of said reaction apparatus, has the same shape as stirring blade 50 which constitutes part of the reaction apparatus shown in FIG. 2.

Figure 7:
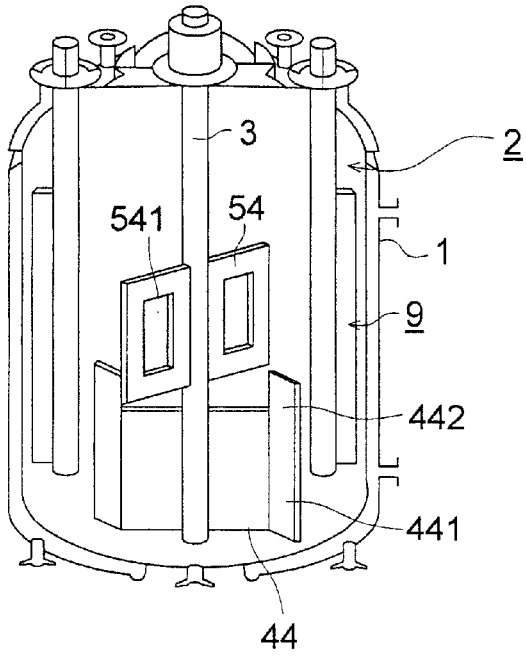
FIG. 7 is a perspective view showing a specific example of a reaction apparatus provided with the preferably employable stirring blades.

In stirring blade 44 which constitutes part of the reaction apparatus shown in FIG. 7, folded section 441 as well as fin 442 is formed.

Further, in the stirring blade 54 which constitutes part of said reaction apparatus, openings 541 are formed in the center of the blade.

Figure 8:
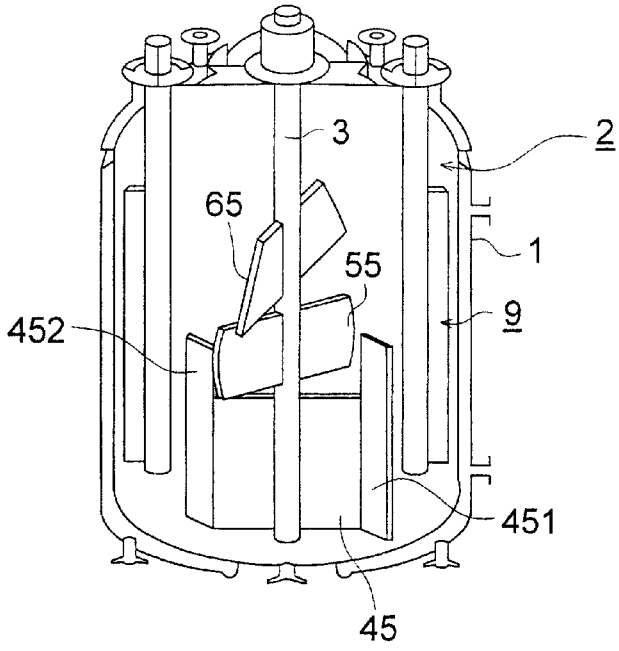
FIG. 8 is a perspective view showing a specific example of a reaction apparatus provided with the preferably employable stirring blades.

In the reaction apparatus shown in FIG. 8, provided are stirring blades at three-level comprised of stirring blade 45 (at the lower level), stirring blade 55 (at the middle level), and stirring blades 65 at the top are provided.

Stirring blades having such folded sections, stirring blades which have upward and downward projections (fins), all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 9:
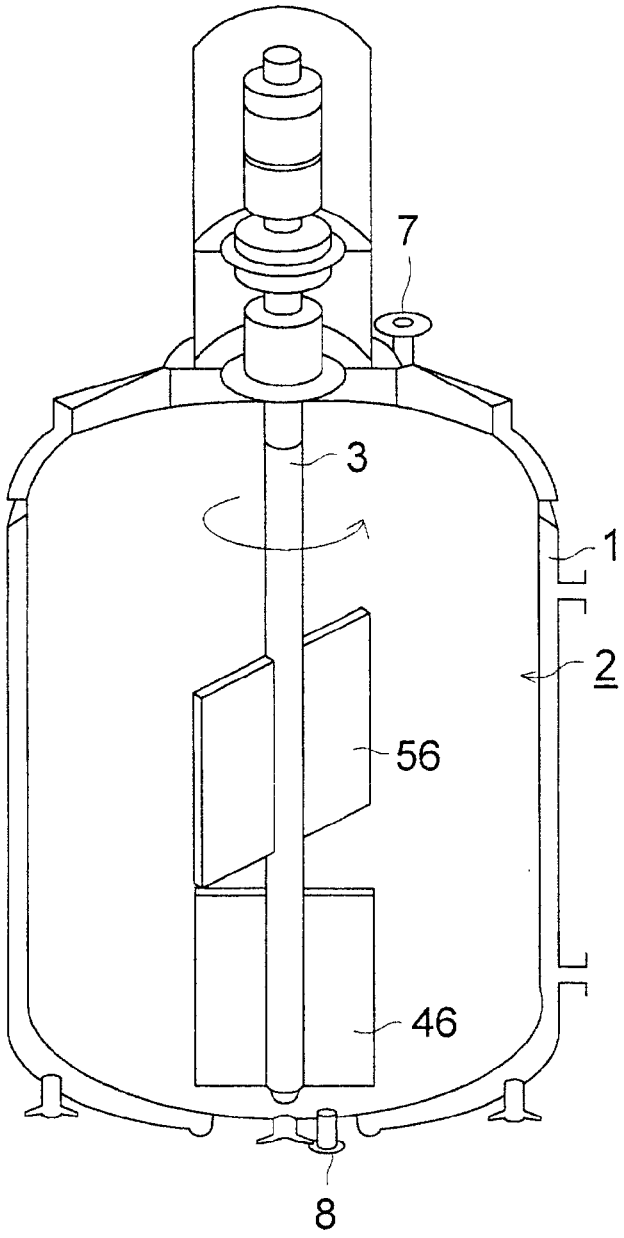
FIG. 9 is a perspective view showing one example of a reaction apparatus employed so that a laminar flow forms.

FIG. 9 shows one example of a reaction apparatus employed when a laminar flow is formed in the suspension polymerization method. Said reaction apparatus is characterized in that no turbulent flow forming member (obstacles such as a baffle plate and the like) is provided.

Stirring blade 46, as well as stirring blade 56 shown in FIG. 9, has the same shape as well as the crossed axis angle of stirring blade 40, as well as stirring blade 50 which constitutes part of the reaction apparatus shown in FIG. 4. In FIG. 9, reference numeral 1 is a heat exchange jacket, 2 is a stirring tank, 3 is a rotation shaft, 7 is an upper material charging inlet, and 8 is a lower material charging inlet.

Apparatuses, which are employed to form a laminar flow, are not limited to ones shown in FIG. 9.

Further, the shape of stirring blades, which constitute part of said reaction apparatuses, is not particularly limited as long as they do not form a turbulent flow, but rectangular plates and the like which are formed with a continuous plane are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed, and for example, it is possible to employ the apparatus shown in FIG. 9. Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle a in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 10(*a*), which are formed of a continuous plane are preferable, and those having a curved plane may also be employed.

The toner of the present invention may be employed as either a single component developer by incorporating, for example, a magnetic material in a toner particle or a two-component developer by mixing with a carrier. It is preferably employed as a two-component developer.

Further, the toner is blended with a carrier, and can be employed as a two-component developer. In such case, employed as magnetic particles of the carrier are conventional materials, known in the art, such as iron, ferrite, magnetite, and the like, as well as alloys of such metal with other metals such as aluminum, lead, and the like. Of these, ferrite is specifically preferred. Said magnetic particles preferably have a volume average diameter of 15 to 100 $\mu$m, and more preferably have one between 25 to 60 $\mu$m. The volume average particle diameter of said carrier is typically measured employing a laser diffraction type particle distribution meter, HELOS (manufactured by Sympatec Co.) provided with a wet type homogenizer.

The carrier is preferably one which is obtained by further coating resin onto magnetic particles, or a so-called resin-dispersed type carrier which is obtained by dispersing magnetic particles into resin. Resin compositions for coating are not particularly limited. For example, employed are olefin based resins, styrene based resins, styrene/acryl based resins, silicone based resins, ester based resins, fluorine containing polymer based resins, and the like. Further, resins to compose the resin-dispersed type carrier are also not particularly limited, and any of those known in the art may be employed. For example, employed may be styrene acrylic resins, polyester resins, fluorine based resins, phenol resins, and the like.

Figure 12:
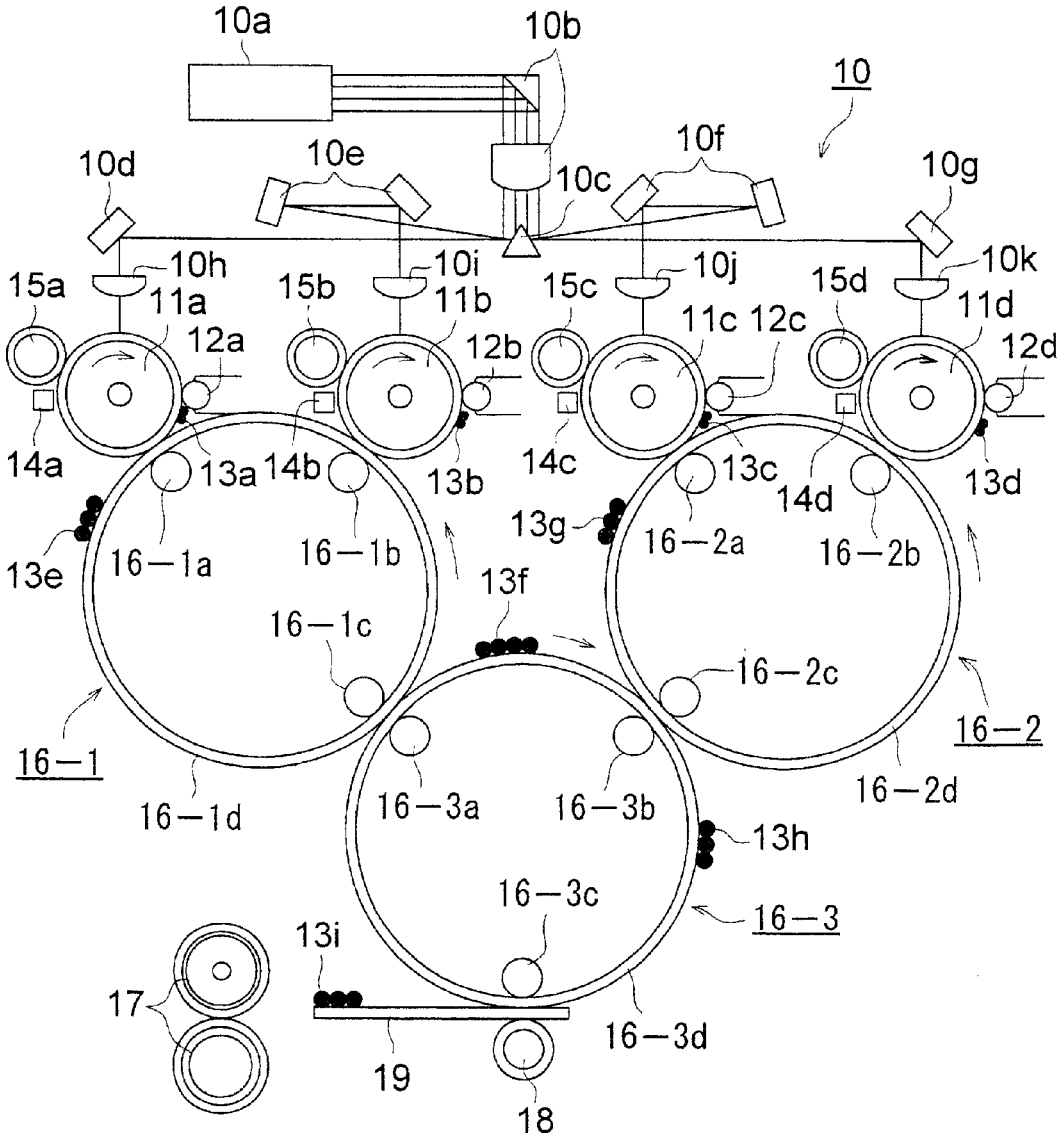
FIG. 12 is a schematic view showing a development apparatus having an electrode contacting with the inner surface of the intermediate transfer member according to the invention.
Figure 13:
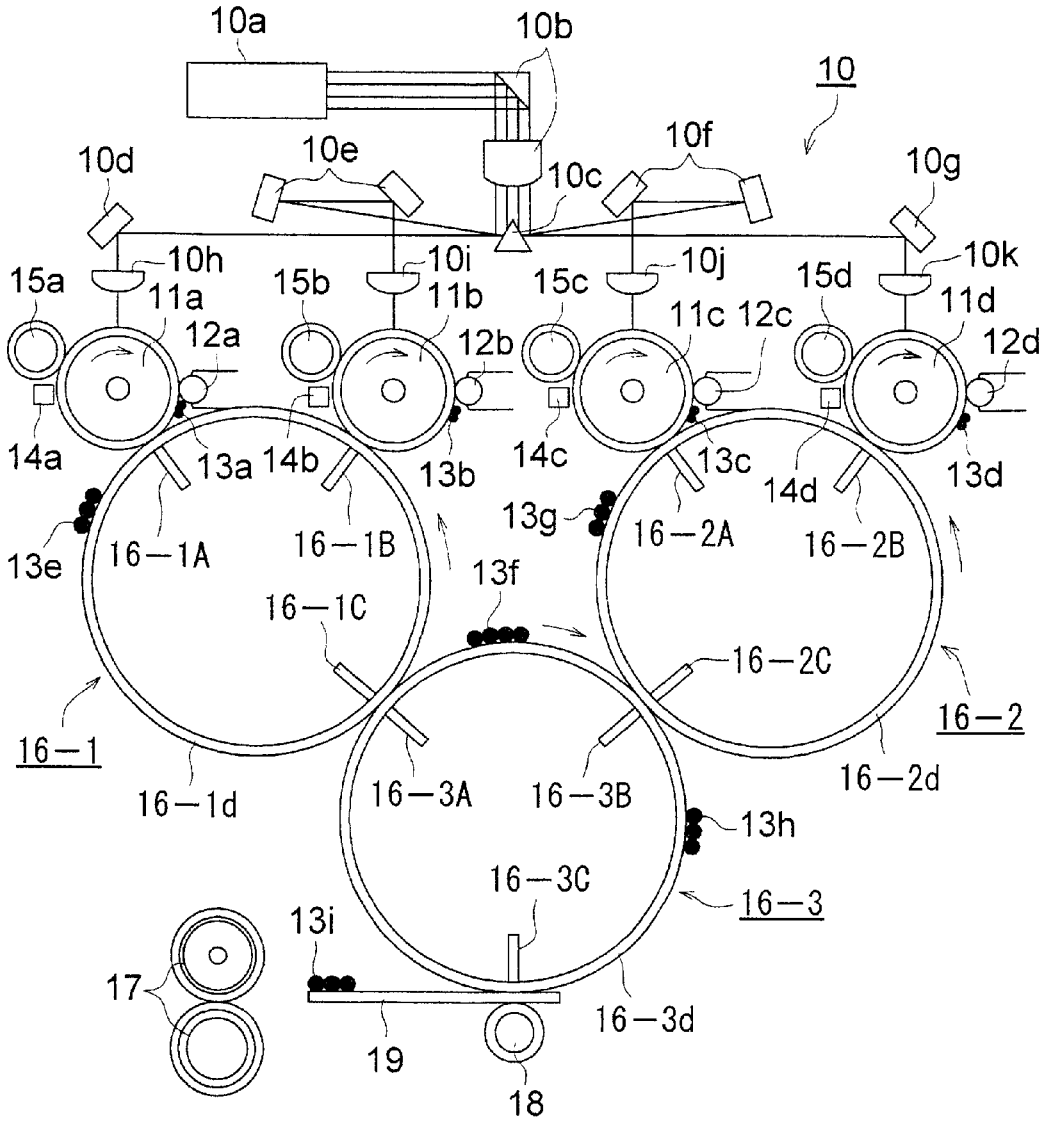
FIG. 13 is a schematic view showing another development apparatus having an electrode contacting with the inner surface of the intermediate transfer member according to the invention.

The image forming method according to the invention and the image forming apparatus to be used in the invention is described referring FIGS. 12 and 13.

FIG. 12 is a schematic structural drawing of an example of a developing apparatus having an electrode contacting with the inner surface of the intermediate transfer member to be used in the invention. In the image forming apparatus shown in FIG. 12, four photoreceptor drums 11*a*, 11*b*, 11*c* and 11*d* are arranged in parallel and erase lumps 14*a*, 14*b*, 14*c* and 14*d*, charging rollers for precharging 15*a*, 15*b*, 15*c* and 15*d*, a laser writing device 10 and developing devices 12*a*, 12*b*, 12*c* and 12*d*, are arranged around the photoreceptors according to the processing order. An intermediate transfer member 16-1 is arranged so as to be contact with both of the photoreceptor drums 11*a* and 11*b*, and an intermediate transfer member 16-2 is arranged so as to be contact with both of the photoreceptor drums 11*c* and 11*d*. Further, an intermediate transfer member 16-3 is arranged so as to be contact with both of the intermediate transfer member 16-1 and the intermediate transfer member 16-2. The intermediate transfer members 16-1, 16-2 and 16-3 respectively have rotatable cylinders made of film, hereinafter referred to as film cylinder, 16-1*d*, 16-2*d* and 16-3*d*, and three groups of electrode shafts, examples of electrode member of the invention, 16-1*a*, 16-1*b* and 16-1*c*; 16-2*a*, 16-2*b* and 16-2*c*; 16-3*a*, 16-3*b*, and 16-3*c* each contacting with the interior surface of each of the cylinders of film 16-1*d*, 16-2*d* and 16-3*d*, respectively.

A bias roller 18 is retractably press-contacted to the intermediate transfer member 16-3. Charging rollers 15*a*, 15*b*, 15*c* and 15*d* are each connected to a power source, not shown in the drawing, and uniformly supply prescribed potential to the surfaces of photoreceptor drums 11*a*, 11*b*, 11*c* and 11*d* by prescribed bias potential overlapped with an alternate current component.

The laser writing device 10 comprises a light source 10*a* irradiating four light beams according to four color image information, black K, yellow Y, magenta M and cyan C, a optical modulation element modulating each the four light beams, a common optical system 10*b* for conducting the four light beams in parallel, a separating optical system 10*c* for separating the four light beams conducted by the common optical system 10 in different directions, cylindrical mirrors 10*d*, 10*e*, 10*f* and 10*g* each conducting the light beam separated by the separating optical system 10*c* to each of the photoreceptor drums 11*a*, 11*b*, 11*c* and 11*d*, respectively, and cylindrical lenses 10*h*, 10*i*, 10*j* and 10*k* for controlling the diameter of the light spot on each of the photoreceptor drums 11*a*, 11*b*, 11*c* and 11*d*. The photoreceptor drums 11*a*, 11*b*, 11*c* and 11*d* are respectively main-scanned by the four light beams in the prescribed direction.

In the developing devices 12*a*, 12*b*, 12*c* and 12*d*, developers each contains a polymerized toner of each of the color of K, Y, M and C and a carrier in a certain ratio and a magnetic brush is formed on a magnetic roller. The toners are each negatively charged by the friction with the carrier. The intermediate transfer members 16-1 and 16-2 are each contacted to the photoreceptor drums 11*a* and 11*b*; and 11*c* and 11*d*, respectively, by a prescribed pressure. The electrode shafts 16-1*a*, 16-1*b* and 16-1*c*; 16-2*a*, 16-2*b* and 16-2*c*; and 16-3*a*, 16-3*b* and 16-3*c* of the intermediate transfer members 16-1, 16-2 and 16-3 and a transfer bias roller 18 are connected to a power source, not shown in the drawing, to apply prescribed potential.

The action of the image forming apparatus of the embodiment is described below. The surface of the photoreceptor drum 11*a* is uniformly charged at −650 V by the charging roller for precharging 15*a*. Then a laser beam is irradiated according to the image information from the laser writing device 10 to form a static latent image corresponding to the first color K. The latent image is visualized by development by the developing device 12*a* for K toner which is arranged so as to face to the photoreceptor drum 1 la and a bias of −500V overlapped with an alternative current composition is applied to the developing device. Thus a toner image 13*a* is formed on the photoreceptor drum 11*a*. The toner image 13*a* is transferred by an electric field caused by the positive charge applied to the intermediate transfer member 16-1 through the electrode shaft 16-1*a* so as to be piled on the later-mentioned toner image 13*b* of the second color Y which is transferred onto the intermediate transfer member 16-1 in advance. Thus a transferred image 13*e* is obtained. Thereafter, the static image on the photoreceptor drum 11*a* was eliminated by the erasing lamp 14*a*.

In the formation of the second color toner image 13*b*, the process of latent image formation on the photoreceptor drum 11*b* and the toner image thereof 13*b* are the same as those of the toner image 13*a* except that the formation of the toner image 13*a* is started earlier by a prescribed time than that of the toner image 13*b*. The toner image 13*b* on the photoreceptor drum 11*b* is transferred onto the intermediate transfer member 16-1 by the electric field formed by the positive charge applied on the intermediate transfer member 16-1 through the electrode shaft 16-1*b* at timing earlier for a prescribed duration than the timing of the transfer of the first color toner image 13*a*.

The transferred image 13*e* is transferred onto the intermediate transfer member 16-3 by the electric field formed by the positive charge applied to the intermediate transfer member 16-3 through the electrode shaft 16-3*a* to form a transferred image 13*f*. At this time, a transferred image 13*g* composed of a third color M toner image 13*c* and a fourth color C toner image 13*d* each formed on the intermediate transfer member 16-2 is transferred onto the intermediate transfer member 16-3 so as to be piled up onto the toner image 13*f*. In such the case, the transferred image 13*g* composed of the third M and fourth color C toner images 13*c* and 13*d* are formed at a time lagged for a prescribed duration behind the formation of the transferred image 13*g* composed of the first color toner image 13*a* and the second color toner image 13*b*. The transfer bias roller 18 is retracted while the intermediate transfer member 16-3 is rotated. A toner image 13*h* composed of the four color toners formed by piling up on the intermediate transfer member 16-3 is transferred at once with a prescribed timing onto an image forming support 19 supplied from a tray, not shown in the drawing, by the electric field formed by the positive charge applied from the transfer bias roller 18. Thus a full color image 13*i* is obtained. The image forming support 19 is finally passed through a fixing device 17 in which the image 13*i* is fused on the image forming support 19 by heat applied from the fixing device to form a fixed image. Thus formation of the full color image is finished.

The photoreceptor drums 11*a*, 11*b*, 11*c* and 11*d*, the transfer bias roller 18, the charging rollers 15*a*, 15*b*, 15*c* and 15*d*, the developing devices 12*a*, 12*b*, 12*c* and 12*d*, the intermediate transfer members 16-1, 16-2 and 16-3, the toners and the fine particle in the embodiment are described below. The photoreceptor drums 11*a*, 11*b*, 11*c* and 11*d* are each an organic photoreceptor.

The transfer bias roller 18 is a shaft of SUS covered with an elastic layer such as a layer of urethane in which carbon black is dispersed for providing electric conductivity. The charging rollers 15*a*, 15*b*, 15*c* and 15*d* are each a shaft of SUS having an elastic layer around it such as a layer of EPDM in which carbon is dispersed and a over coated layer such as a layer of an acryl resin containing carbon dispersed therein which is provided on the surface of the elastic layer.

The developing devices 12*a*, 12*b*, 12*c* and 12*d* each has a developing sleeve in which a magnet roller having seven poles is coaxially arranged. The developer is mixed by a paddle so as to be charged and supplied to the circumference of the developing sleeve. The developer supplied onto the sleeve is smoothed by a developer layer thickness controlling member to form a developer layer having a prescribed thickness on the sleeve. The distance between the developing sleeve and each of the photoreceptor drums 11*a,* 11*b,* 11*c* and 11*d* is set at a specified value such as 0.5 mm. The magnet roller is arranged so that the portion in between the poles is faced to each of the photoreceptor drums 11*a,* 11*b,* 11*c* and 11*d.* Accordingly, the thickness of the toner layer is thinner than the distance between the developing sleeve and the photoreceptor and the toner is jumped by the electric field to the photoreceptor drums 11*a,* 11*b,* 11*c* and 11*d* to develop the image.

The transfer process is described below. In the invention, the transfer of the toner from the surface of the photoreceptor drum to the intermediate transfer member 16-1 or 16-2 is referred to as the primary transfer. In the primary transfer, a voltage with a polarity opposite to that of the charge of the toner, +0.6 kv here, is applied to the two electrode shafts 16-1*a* and 16-1*b* to move the toner from the surfaces of photoreceptor drums 11*a* and 11*b* to the intermediate transfer member 16-1. The diameter of each of the electrode shafts 16-1*a* and 16-1*b* is small, consequently the area of the electric field is made very narrow compared with the case in which the intermediate transfer member 16-1 is a drum and the electrode layer exists just under the resistive layer at which the transfer electric field is applied.

The transfer of the toner image from the intermediate transfer member 16-3 to the image forming support 19 is described below. A positive voltage is applied to the transfer bias roller 18 from a power source, not shown in the drawing, and the electrode shaft 16-3*c* is grounded, which is arranged in the intermediate transfer member 16-3 and faced to the intermediate transfer roller 18. The toner image 13*h* is transferred by the electric field formed between the electrode shaft 16-3*c* and the transfer bias roller 18 onto the image forming support 19 which is transported by a prescribed timing. The transfer ratio can be held at almost 100% through all the transferring processes when the toner satisfies the requirements of the invention. Thus a high quality full color image can be obtained, which is lowered in defects such as lowering of the density and occurrence of the blur.

The film cylinder may be one made from a semiconductor or an insulator having a volume resistivity of not less than $10^7$ Ωcm, even though a film cylinder composed of polyimide and fluorinated latex having a volume resistivity of $10^{13}$ Ωcm is described in the embodiment. The leak current between the electrode shaft and another member can be inhibited by making the volume resistivity to not less than $10^7$ Ωcm.

As above-described, in the image forming apparatus of the embodiment, an electric field to jump the toner to outside of the transferring nip is not formed since the intermediate transfer members 16-1, 16-2 and 16-3 have the rotatable film cylinder 16-1*d,* 16-2*d* and 16-3*d,* the three groups electrode shafts 16-1*a,* 16-1*b* and 16-1*c;* 16-2*a,* 16-2*b* and 16-2*c;* and 16-3*a,* 16-3*b* and 16-3*c* each contacted to the inner surface of the film cylinder 16-1*d,* 16-2*d* and 16-3*d.* Consequently, the high quality image can be obtained. The film cylinder 16-1*d,* 16-2*d* and 16-3*d,* to which sufficient rigidity is provided, can be driven as a rotating body. Therefore, the intermediate transfer member can be easily driven without control for walking. In the embodiment, it can be allowed to apply a low voltage to each of the intermediate transfer members 16-1, 16-2 and 16-3 since the intermediate transfer members 16-1, 16-2 and 16-3 are constructed so as to form the image by a poly-step processing. Accordingly, the power source can be made compact.

FIG. 13 is a schematic drawing of an example of the developing apparatus having the electrode member contacting with the inner face of the intermediate transfer member to be used in the invention. The image forming apparatus of FIG. 13 is different from the image forming apparatus of FIG. 12, in the apparatus of FIG. 13, the three groups of the electrode shafts 16-1*a,* 16-1*b* and 16-1*c;* 16-2*a,* 16-2*b* and 16-2*c;* and 16-3*a,* 16-3*b* and 16-3*c* each contacted with the intermediate transfer member 16-1, 16-2 and 16-3 of the apparatus of FIG. 12 are each replaced by three groups of electrode blade 16-1A, 16-1B and 16-1C; 16-2A, 16-2B and 16-2C; and 16-3A, 16-3B and 16-3C, respectively.

The electrode blades are each a blade of SUS having a curvature at the point thereof. The electrode blades 16-1A, 16-1B and 16-1C; and 16-2A, 16-2B and 16-2C are arranged so that each of the blades is touched to the back side of each of the intermediate transfer members 16-1 and 16-2 at the points at which the surface of the intermediate transfer member 16-1 is contacted with the photoreceptor drums 11*a,* 11*b* or the third intermediate transfer drum 16-3, and the points at which the surface of the intermediate transfer member 16-2 is contacted with the photoreceptor drums 11*c,* 11*d* or the third intermediate transfer drum 16-3. The electrode blades are each connected to a power source, not shown in the drawing, so that the prescribed voltage is applied. The electrode blades 16-3A, 16-3B are arranged so that the each of the blades is touched to the back side of each of the intermediate transfer members 16-3 at the points at which the intermediate transfer member 16-3 is contacted with the intermediate transfer members 16-1, 16-2, ant the electrode blade 16-3C is contacted with the back side of the intermediate transfer drum 16-3 at which the surface of the intermediate transfer drum 16-3 is contacted with the transfer bias roller 18. The electrode blades are each connected to a power source, not shown in the drawing, so that the prescribed voltage is applied.

The transfer process is described below. In the primary transfer process, a voltage of a polarity opposite to the charge of the toner is applied to the two blades 16-1A and 16-1B to transfer the negatively charged toner from the surfaces of the photoreceptor 11*a* and 11*b* to the intermediate transfer member 16-1. The thickness of each of the electrode blade 16-1A and 16-1B is small, therefore the area of the electric field is made very narrow compared with the case in which the intermediate transfer member 16-1 is a drum and the electrode layer exists just under the resistive layer at which the transfer electric field is applied.

The transfer of the toner image from the intermediate transfer member 16-1 or 16-2 to the intermediate transfer member 16-3 is described below. A positive voltage is applied to the electrode blades 16-1A and 16-3B of the intermediate transfer member 16-3 from a power source, not shown in the drawing, and the electrode blades 16-1C and 16-2C are grounded, which are each arranged at inside of the intermediate transfer members 16-1 and 16-2, respectively, so as to face to the intermediate transfer member 16-3. The toner images each carried by the intermediate transfer members 16-1 and 16-2 are each transferred onto the intermediate transfer member 16-3 by the electric fields formed between the electrode blades 16-1C and 16-3A, and the electrode blades 16-2C and 16-3B. The blur of the image is inhibited to small since the area of the electric field is narrow also at the transfer nip zone.

Moreover, the transfer of the toner image from the intermediate transfer member 16-3 to the image forming support 19 is described. A positive voltage is applied to the transfer bias roller from a power source not shown in the drawing, and the electrode blade 16-3C is grounded which is arranged at the inside of the intermediate transfer member 16-3 so that to be faced to the transfer bias roller 18. The toner image carried on the intermediate transfer member 16-3 is transferred by the electric field formed between the electrode blade 16-3C and the transfer bias roller 18 onto the image forming support 19 transported at the prescribed timing. Thus a high quality full color image inhibited in lowering of the density and occurrence of the blur is obtained.

A fixing method so called as a contact-heat fixing method is preferably usable in the invention. A pressure-contact-heat fixing method, particularly, a heating roller fixing method and a direct-pressure-heat fixing method using a rotatable pressing member which is arranged at a fixed position and includes a heater therein are usable as the contact-heat fixing method.

Figure 14:
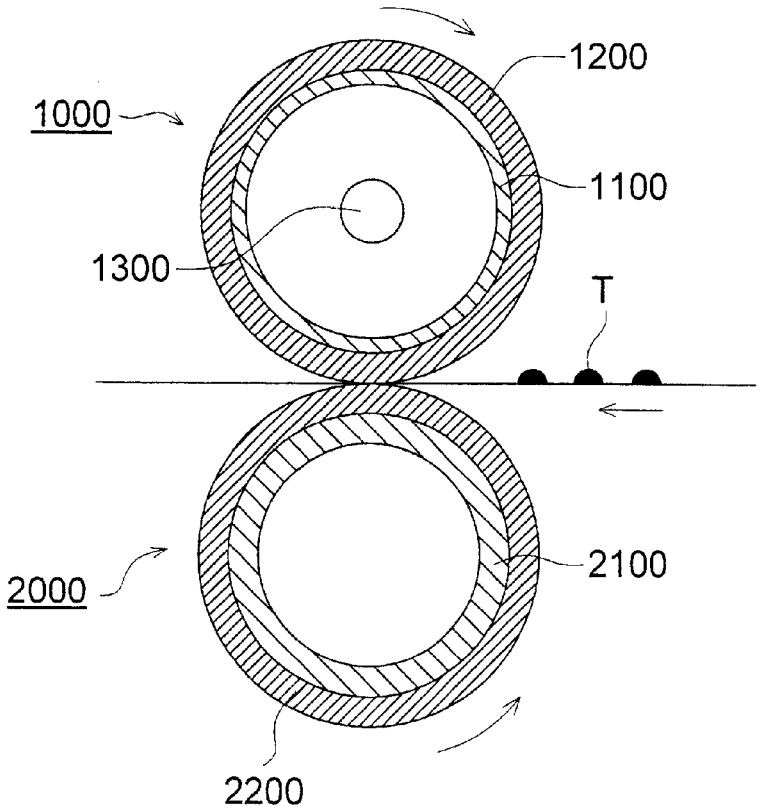
FIG. 14 is a schematic view showing a sectional view of an example of a fixing device according to the invention.

FIG. 14 shows a cross-section of an example of the fixing device to be used in the invention. The fixing device shown in FIG. 14 has a heating roller 1000 and a pressure roller 2000 contacted to the heating roller by pressure. In FIG. 14, T is the toner image formed on an image forming support or a recording member typically a paper sheet.

The heating roller 1000 is composed of a metal shaft 1100 and a cover layer 1200 formed by silicone rubber and includes a heating member 1300 composed of a linear heater. The surface of the heating roller is preferably covered with a layer or a tube of a polymer such as tetrafluoroethylene and polytetrafluoroethylene-perfluoroalkoxyvinyl ether copolymer. The thickness of such the polymer is from 10 to 500 $\mu$m, preferably from 20 to 200 $\mu$m.

The metal central shaft 1100 is composed of a metal or an alloy thereof and the internal diameter of the shaft is preferably from 10 to 70 mm. As the material of the shaft, for example, iron, aluminum and copper and an alloy thereof are usable even though there is no limitation on the material.

The thickness of the metal shaft is preferably from 0.1 to 2 mm, which is decided considering the balance of the requirement of the energy saving by thinning and the strength depending on the material. For example, it is preferable that the thickness of the shaft of aluminum is controlled to 0.8 mm for obtaining strength the same as that of the shaft made from iron with a thickness of 0.75 mm.

Examples of the silicone rubber constituting the cover layer 1200 include a silicone rubber such as LTV, RTV and HTV and a sponge thereof.

The thickness of the cover layer 1200 is preferably from 0.1 to 30 mm, more preferably from 0.1 to 20 mm. When the thickness is less than 0.1 mm, the width of nipping cannot be made large and the effect of soft fixing is insufficient.

Figure 15:
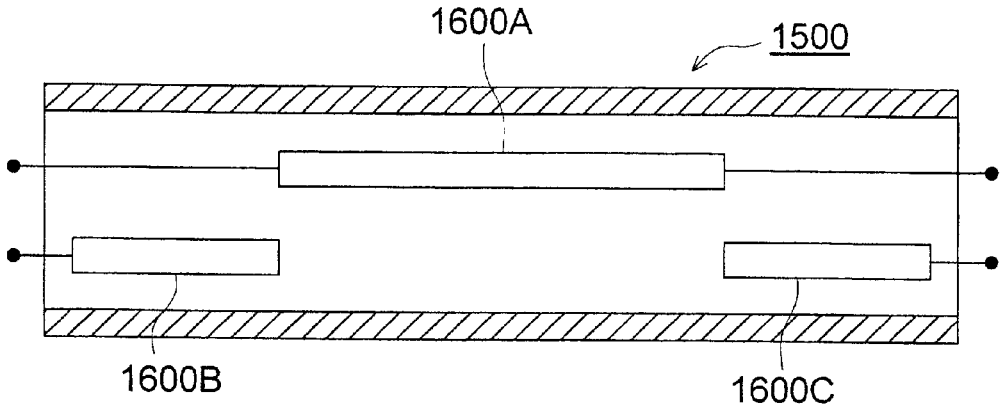
FIG. 15 is a schematic view showing arrangement of heaters within a fixing device according to the invention.

A halogen heater can be suitably used as the heating member 1300. Plural, not only one, heating members may used as shown in FIG. 15 so that the heating portion can be varied according to the size or width of the paper to be passed. In the heating roller 1500 shown in FIG. 14, a halogen heater 1600A for heating the central portion of the roller and halogen heaters 1600B and 1600C for heating the each end portions of the roller are arranged.

In the heating roller 1500 shown in FIG. 15, electric current is applied only to the heater 1600A when a narrow width paper sheet is passed and electric current is applied further to the heaters 1600B and 1600C when a wide paper sheet is passed.

In FIG. 14, a pressure roller 2000 is composed of a metal shaft 2100 and a cover layer of rubber 2200 formed on the surface of the shaft. Urethane rubber and silicone rubber, preferably a heat resistive silicone rubber, may be used for the cover layer even though there is no specific limitation on the rubber of the cover layer. As the silicone rubber, materials the same as those usable in the cover layer 1200 can be used.

Aluminum, iron and copper and an alloy thereof may be used as the material of the metal shaft 2100 even though there is no limitation thereon.

The thickness of the cover layer 2200 is from 0.1 to 30 mm, preferably from 0.1 to 20 mm. When the thickness is less than 0.1 mm, the width of nipping cannot be made large and the effect of soft fixing is insufficient.

The Ascar hardness of the silicone rubber or rubber constituting the cover layers 1200 and 2200 is preferably less than 70°, more preferably less than 60°, and a silicone rubber sponge is preferable.

The contacting load (the total load) applied between the heating roller 1000 and the pressure roller 2000 is usually from 40 to 350N, preferably from 50 to 300N, more preferably from 50 to 250N. The contacting load is decided considering the strength of the heating roller 1000 or the thickness of the metal shaft. For instance, the load of less than 250N is preferable when the heating roller has an iron shaft having the thickness of 0.3 mm.

The nip width is preferably from 4 to 10 mm from the viewpoint of the anti-off-set property and the fixing ability. The surface pressure of the nip is preferably from 0.6 to $1.5\times10^5$ Pa.

In an example of the fixing condition of the fixing device shown in FIG. 13, the fixing temperature or the surface temperature of the heating roller 1000 is from 150 to 210° C. and the line speed of fixing is from 80 to 640 mm/sec.

A cleaning means for the fixing device may be provided in the fixing device to be used in the invention according to necessity. In such the case, a cleaning method can be used, in which silicone oil is supplied to the upper roller of the fixing device by a pad, a roller or a web each immersed with the silicone oil.

As the silicone oil having a high heat resistivity such as polydimethylsilicone and polydiphenylsilicone is used. One having a viscosity of from 1 to 100 Pas at 20° C. is preferably used since the flowing amount of the oil is made to large at the use when the viscosity of the oil is excessively low.

EXAMPLES

The present inventing will now be detailed with reference to examples. The term "part(s)" denotes part(s) by weight.

Latex Preparation Example 1

Placed into a 5,000 ml separable flask fitted with a stirring unit, a temperature sensor, a cooling pipe, and a nitrogen gads inlet unit was a surface active agent solution (water based medium) prepared by dissolving 7.08 g of an anionic surface active agent (sodium dodecylbenzenesulfonate: SDS) in 2,760 g of deionized water, and the interior temperature was raised to 80° C. under a nitrogen gas flow while stirring at 230 rpm.

On one side, a monomer solution was prepared by adding 72.0 g of the compound represented by the aforementioned formula 19) to a monomer mixture solution consisting of 115.1 g of styrene, 42.0 g of n-butyl acrylate, and 10.9 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion comprised of emulsion particles (oil droplets), having a uniform dispersed particle diameter, was prepared.

Subsequently, a solution prepared by dissolving 0.84 g of a polymerization initiator (potassium persulfate: KPS) in 200 g of deionized water was added to the resulting dispersion, and the resulting mixture underwent polymerization while being heated to 80° C. and stirred for 3 hours, whereby latex was prepared.

Subsequently, a solution prepared by dissolving 7.73 g of said polymerization initiator (KPS) in 240 ml of deionized water was added to the resulting latex. After 15 minutes, a monomer mixture solution consisting of 383.6 g of styrene, 140.0 g of n-butyl acrylate, 36.4 g of methacrylic acid, and 13.7 g of t-dodecylmercaptan was added dropwise over 120 minutes. After the dropwise addition, the resulting mixture underwent polymerization while stirring for 60 minutes, and then cooled to 40° C. Thus latex was obtained.

The resulting latex was designated as "Latex (1)". Toner Preparation: Example of Emulsion Polymerization Coagulation (Production Example 1Bk)

Added to 160 ml of deionized water were 9.2 g of sodium n-dodecylsulfate and were dissolved while stirring. While stirring the resulting solution, 20 g of carbon black, "Regal 330R" (produced by Cabot Corp.), were gradually added, and subsequently dispersed employing a stirring unit, "Clearmix" (produced by M Tech Ltd.) equipped with a high speed rotating rotor. Thus a colorant particle dispersion (hereinafter referred to as "Colorant Dispersion (1)) was prepared. The colorant particle diameter of said Colorant Dispersion (1) was 112 nm in a weight average particle diameter.

Placed into a 5-liter four-necked flask fitted with a temperature sensor, a cooling pipe, a nitrogen gas inlet unit, and a stirring unit were 1250 g of Latex (1) obtained in Preparation Example 1, 2000 ml of deionized water, and Colorant Dispersion (1) prepared as previously described, and the resulting mixture was stirred. After adjusting the interior temperature to 30° C., 5M/L aqueous sodium hydroxide solution was added to the resulting solution, and the pH was adjusted to 10.0. Subsequently, an aqueous solution prepared by dissolving 52.6 g of magnesium chloride tetrahydrate in 72 ml of deionized water was added at 30° C. over 10 minutes. After setting aside for 3 minutes, the resulting mixture was heated so that the temperature was increased to 90° C. within 6 minutes (at a temperature increase rate of 10° C./minute) While maintaining the resulting state, the diameter of coalesced particles was measured employing a "Coulter Counter TA-II". When the volume average particle diameter reached 6.5 $\mu$m, the growth of particles was terminated by the addition of an aqueous solution prepared by dissolving 115 g of sodium chloride in 700 ml of deionized water, and further fusion was continually carried out at a liquid media temperature of 85±2° C. for 1.5 15 hours individually for each sample while being heated while stirring. Thereafter, the temperature was decreased to 30° C. at a rate of 6° C./minute. Subsequently, the pH was adjusted to 2.0, and stirring was terminated. The resulting coalesced particles were collected through filtration, and repeatedly washed with deionized water. Then washed particles were dried at 60° C. air, by employing flush jet dryer, and then dried by fluidized bed dryer at 60° C. One weight part of silica fine particles was added externally to 100 weight parts of the obtained colored particles by Henschel mixer The colored particles Bk2 through Bk5 were obtained in the similar way to the colored particles Bk1 by modifying stirring rate, heating period, during the salting-out/fusion process to control the shape and variation coefficient of shape coefficient, and by classification in the liquid to control particle diameter and variation coefficient of particle size distribution as described in Table 1.

(Production Example Y1 through C5)

Colored toners were obtained in the same manner as Production Example 1Bk, except that carbon black was replaced with dyes described below.

Yellow Toners Y1 through Y5

Yellow toners Y1 through Y5 were obtained by employing C.I. Pigment Yellow 185 in place of carbon black.

Magenta Toners M1 through M5

Magenta toners M1 through M5 were obtained by employing C.I. Pigment Red 122 in place of carbon black.

Cyan Toners C1 through C5 Cyan toners C1 through C5 were obtained by employing C.I. Pigment Blue 15:3 in place of carbon black.

(Toner Production Example 2: Example of a Suspension Polymerization Method)

A mixture comprised of 165 g of styrene, 35 g of n-butyl acrylate, 10 g of carbon black, 2 g of a di-t-butyl salicylic acid metal compound, 8 g of a styrene-methacrylic acid copolymer, and 20 g of paraffin wax (exemplified compound 19) were heated to 60° C., and uniformly dissolve dispersed employing a TK homomixer (manufactured by Tokushu Kika Kogyo Co.). Then, 10 g of 2,2'-azobis(2,4-valeronitrile) were added and dissolved, and a polymerizable monomer composition was prepared. Subsequently, 710 g of deionized water and 450 g of 1M aqueous sodium phosphate solution were added, and 68 g of 1.0 M calcium chloride was gradually added to the resulting mixture while stirring at 13,000 rpm employing a TK homomixer, and a suspension, in which tricalcium phosphate had been dispersed, was prepared. The above-mentioned polymerizable monomer composition was added to the resulting suspension, and the resulting mixture was stirred at 10,000 rpm for 20 minutes employing a TK homomixer to granulate the polymerizable monomer composition. Thereafter, employing a reaction apparatus equipped with stirring blades constituted as shown FIG. 2 (having crossed axis angle $\alpha$: 45°) the resulting particles underwent reaction at 75 to 95° C. for 5 to 15 hours. Tricalcium phosphate was dissolved and removed employing hydrochloric acid. Next, employing a centrifuge, classification was carried out utilizing a centrifugal sedimentation method, and filtration, washing, and drying were carried out. Toner prepared employing the suspension polymerization method was then obtained by externally adding one weight part of fine silica particles to 100 weight parts of the obtained colored particles by employing Henschel mixer. Black toner Bk6 was obtained.

During the above-mentioned polymerization, monitoring was carried out, and by controlling the liquid temperature, the stirrer rotation frequency, and the heating time, the shape as well as the variation coefficient of the shape coefficient was controlled. Further, by employing the classification in liquid, the particle diameter as well as the variation coefficient of the particle size distribution was optionally adjusted. Thus, toners Bk7 and Bk8 were prepared.

(Toner Production Example 3: Example of a Suspension Polymerization Method)

Yellow toners Y6 through Y8 were obtained by employing 1.05 kg of C.I. Pigment Yellow 185 in place of carbon black in Preparation Example 2.

(Toner Production Example 4: Example of a Suspension Polymerization Method)

Magenta toners M6 through M8 were obtained by employing 1.20 kg of C.I. Pigment Red 122 in place of carbon black in Preparation Example 2.

(Toner Production Example 5: Example of a Suspension Polymerization Method)

Cyan toners C6 through C8 were obtained by employing 0.60 kg of C.I. Pigment Blue 15:3 in place of carbon black in Preparation Example 2.

(Toner Production Example 6: Example of a Suspension Polymerization Method)

Black toner 9 having specific shape coefficient and particle size distribution characteristics as described in Table 1 in the similar manner to Preparation Example 2 excepted that reaction vessel as shown by FIG. 9 having crossed axis $\alpha$ of 15° and classification by a centrifuge in liquid was omitted.

(Toner Production Example 7: Example of a Suspension Polymerization Method)

Yellow toners Y9 was obtained by employing 1.05 kg of C.I. Pigment Yellow 185 in place of carbon black in Preparation Example 2.

(Toner Production Example 8: Example of a Suspension Polymerization Method)

Magenta toners M9 was obtained by employing 1.20 kg of a quinacridone magenta pigment C.I. Pigment Red 122 in place of carbon black in Preparation Example 6.

(Toner Production Example 5: Example of a Suspension Polymerization Method)

Cyan toner C9 was obtained by employing 0.60 kg of a phthalocyanine pigment C.I. Pigment Blue 15:3 in place of carbon black in Preparation Example 6.

(Toner Production Example 10: Example of a Pulverization Method)

Toner raw materials comprised of 100 kg of a styrene-n-butyl acrylate copolymer resin, 10 kg of carbon black, and 4 weight parts of polypropylene were preliminary mixed employing a Henschel mixer, and the resulting mixture was fuse-kneaded employing a biaxial extruder, preliminary pulverized employing a hammer mill, and further pulverized employing a jet method pulverizing unit. The resulting powder was dispersed (for 0.05 second at 200 to 300° C.) into the heated air flow of a spray drier to obtain shape adjusted particles. The resulting particles were repeatedly classified employing a forced air classifying unit until the targeted particle diameter distribution was obtained. Externally added to 100 weight parts of the obtained colored particles was one part of fine silica particles and mixed employing a Henschel mixer. Thus black toner Bk10, prepared employing the pulverization method, was obtained.

The shape as well as the variation coefficient of the shape coefficient was modified, and further, the particle diameter as well as the variation coefficient of the particle size distribution was modified in Example 10 described above. Thus toner Bk11 shown in Table 1 were prepared.

(Toner Production Example 11: Example of a Pulverization Method)

Yellow toners Y10 and Y11 were obtained by employing 1.05 kg of C.I. Pigment Yellow 185 in place of carbon black in Preparation Example 10.

(Toner Production Example 12: Example of a Pulverization Method) Magenta toners M10 and M11 were obtained by employing 1.20 kg of a quinacridone magenta pigment C.I. Pigment Red 122 in place of carbon black in Preparation Example 10.

(Toner Production Example 13: Example of a Pulverization Method)

Cyan toner C10 and C11 were obtained by employing 0.60 kg of a phthalocyanine pigment C.I. Pigment Blue 15:3 in place of carbon black in Preparation Example 10.

Shape characteristics and so on are listed in the following Table 1.

TABLE 1

| Toner No. | Shape Coefficient Ratio | Variation Coefficient the Shape Coefficient (%) | Shape Coefficient Ratio of 1.0 to 1.6 (in %) | Ratio of Toner Particles Without Corners (in %) | Number Average Particle Diameter (in $\mu$m) | Sum M of $m_1$ and $m_2$ (in %) | Variation Coefficient of Particle Number Distribution (in %) |
|---|---|---|---|---|---|---|---|
| Bk1 | 1.54 | 13 | 86 | 85 | 5.3 | 72 | 25 |
| Y1 | 1.46 | 14 | 82 | 82 | 5.2 | 74 | 24 |
| M1 | 1.48 | 12 | 89 | 83 | 5.4 | 78 | 25 |
| C1 | 1.49 | 11 | 88 | 87 | 5.3 | 72 | 23 |
| Bk2 | 1.47 | 11 | 88 | 88 | 5.9 | 76 | 21 |
| Y2 | 1.43 | 12 | 88 | 88 | 5.9 | 78 | 20 |
| M2 | 1.44 | 13 | 89 | 89 | 5.8 | 75 | 21 |
| C2 | 1.41 | 10 | 90 | 88 | 5.9 | 75 | 21 |
| Bk3 | 1.37 | 14 | 79 | 78 | 5.2 | 72 | 23 |
| Y3 | 1.33 | 14 | 78 | 78 | 5.1 | 71 | 21 |
| M3 | 1.34 | 13 | 79 | 79 | 5.0 | 74 | 22 |
| C3 | 1.31 | 13 | 78 | 78 | 5.3 | 73 | 23 |
| Bk4 | 1.27 | 11 | 89 | 93 | 5.4 | 75 | 22 |
| Y4 | 1.29 | 11 | 87 | 92 | 5.7 | 75 | 21 |
| M4 | 1.28 | 12 | 89 | 91 | 5.5 | 76 | 21 |
| C4 | 1.28 | 11 | 88 | 93 | 5.5 | 76 | 20 |
| Bk5 | 1.10 | 10 | 59 | 94 | 5.3 | 62 | 32 |
| Y5 | 1.15 | 13 | 57 | 97 | 5.3 | 62 | 32 |
| M5 | 1.12 | 11 | 58 | 98 | 5.5 | 61 | 31 |
| C5 | 1.14 | 9 | 56 | 95 | 5.5 | 64 | 34 |
| Bk6 | 1.79 | 20 | 52 | 74 | 5.4 | 72 | 29 |
| Y6 | 1.78 | 21 | 53 | 77 | 5.4 | 72 | 28 |
| M6 | 1.76 | 21 | 54 | 75 | 5.4 | 71 | 29 |
| C6 | 1.81 | 19 | 55 | 74 | 5.6 | 74 | 27 |
| Bk7 | 1.31 | 12 | 69 | 89 | 5.6 | 79 | 18 |
| Y7 | 1.32 | 11 | 68 | 90 | 5.6 | 78 | 18 |
| M7 | 1.31 | 12 | 67 | 91 | 5.6 | 79 | 19 |
| C7 | 1.31 | 13 | 69 | 90 | 5.8 | 79 | 19 |

TABLE 1-continued

| Toner No. | Shape Co-efficient Ratio | Variation Coefficient the Shape Coefficient (%) | Shape Co-efficient Ratio of 1.0 to 1.6 (in %) | Ratio of Toner Particles Without Corners (in %) | Number Average Particle Diameter (in μm) | Sum M of $m_1$ and $m_2$ (in %) | Variation Coefficient of Particle Number Distribution (in %) |
|---|---|---|---|---|---|---|---|
| Bk8 | 1.16 | 18 | 44 | 92 | 5.7 | 80 | 16 |
| Y8 | 1.16 | 19 | 45 | 92 | 5.7 | 81 | 14 |
| M8 | 1.17 | 17 | 46 | 93 | 5.5 | 83 | 15 |
| C8 | 1.13 | 25 | 46 | 96 | 5.7 | 84 | 14 |
| Bk9 | 1.31 | 11 | 71 | 90 | 5.6 | 76 | 20 |
| Y9 | 1.32 | 12 | 70 | 91 | 5.6 | 77 | 22 |
| M9 | 1.32 | 13 | 72 | 92 | 5.6 | 79 | 23 |
| C9 | 1.31 | 13 | 73 | 91 | 5.8 | 78 | 21 |
| Bk10 | 1.54 | 14 | 83 | 69 | 5.9 | 79 | 18 |
| Y10 | 1.52 | 14 | 82 | 65 | 5.5 | 78 | 18 |
| M10 | 1.52 | 12 | 83 | 61 | 5.7 | 79 | 17 |
| C10 | 1.53 | 13 | 83 | 63 | 5.9 | 79 | 19 |
| Bk11 | 1.58 | 19 | 73 | 52 | 5.6 | 63 | 36 |
| Y11 | 1.61 | 25 | 72 | 54 | 5.4 | 64 | 33 |
| M11 | 1.57 | 17 | 73 | 51 | 5.4 | 63 | 35 |
| C11 | 1.56 | 20 | 73 | 50 | 5.3 | 65 | 36 |

(Production of Developer Materials)

Developer materials 1 through 15 were prepared by mixing each of Toners with a 60 μm ferrite carrier coated licone resin for each color in the ratio shown in Table 2.

Characteristics of the developers 1 through 15 are shown in Table 2.

TABLE 2

| Developer | Combination of Toners | R1 | R2 | R3 | R4 |
|---|---|---|---|---|---|
| 1 | Bk1/Y1/M1/C1 | 0.051 | 0.21 | 0.037 | 0.080 |
| 2 | Bk2/Y2/M2/C2 | 0.041 | 0.15 | 0.017 | 0.048 |
| 3 | Bk3/Y3/M3/C3 | 0.044 | 0.07 | 0.057 | 0.087 |
| 4 | Bk4/Y4/M4/C4 | 0.016 | 0.08 | 0.053 | 0.091 |
| 5 | Bk5/Y5/M5/C5 | 0.043 | 0.25 | 0.037 | 0.059 |
| 6 | Bk6/Y6/M6/C6 | 0.028 | 0.10 | 0.036 | 0.069 |
| 7 | Bk7/Y7/M7/C7 | 0.008 | 0.15 | 0.034 | 0.053 |
| 8 | Bk8/Y8/M8/C8 | 0.034 | 0.13 | 0.035 | 0.125 |
| 9 | Bk9/Y9/M9/C9 | 0.008 | 0.15 | 0.034 | 0.130 |
| 10 | Bk10/Y10/M10/C10 | 0.013 | 0.14 | 0.034 | 0.105 |
| 11 | Bk11/Y11/M11/C11 | 0.013 | 0.10 | 0.054 | 0.083 |
| 12 | Bk1/Y2/M3/C4 | 0.169 | 0.15 | 0.102 | 0.200 |
| 13 | Bk2/Y2/M3/C4 | 0.129 | 0.15 | 0.102 | 0.091 |
| 14 | Bk3/Y2/M2/C3 | 0.069 | 0.14 | 0.119 | 0.130 |
| 15 | Bk2/Y2/M4/C4 | 0.238 | 0.33 | 0.073 | 0.048 |

The prepared toners were tested by employing a digital color copying machine shown in FIG. 12, wherein a contacting-pressure type heat fixing member shown in FIG. 13 was employed. The contacting-pressure type heat fixing member is detailed below.

The fixing member comprises an upper roller composed of a cylindrical aluminum alloy tube of 30 mm inner diameter and 310 mm width having a thickness of 0.8 mm and including a heater at the center, the surface of which is covered with a sponge silicone rubber having Ascar C hardness of 30 and thickness of 8 mm, and a lower roller composed of a cylindrical iron tube of 40 mm inner diameter having a thickness of 2.0 mm covered with silicone rubber sponge having Ascar C hardness of 30 and thickness of 2 mm. The nip width was set at 5.8 mm. Employing this fixing member, the printing line speed was set at 180 mm/second.

Further, employed as the cleaning mechanism of the fixing device was a supply method employing a web method in which polydiphenylsilicone (having a viscosity of 10 Pa s at 20° C.) was impregnated.

The fixing temperature was controlled by regulating the surface temperature of the upper roller, the temperature of which was set at 175° C. Coating amount of silicone oil was set as 0.6 mg per A4 size sheet.

Color difference each of the first copy and 100,000th copy was measured. The measurement was conducted in the following method.

The secondary colors (red, blue, and green) of the solid image portion in each of images formed on the first sheet and 20,000th sheet were measured by a "Macbeth Color-Eye 7000", and the color difference was calculated employing a CMC (2:1) color difference formula.

If the color difference obtained by the CMC (2:1) color difference formula was not more than 5, the variation of hue of the formed images was judged to be within the tolerance range.

Definition of line image formed by toner dots each of four colors was compared so as to evaluate the smoothness of image after transfer and fixing process. The definition was number of lines per mm of line image perpendicular to the direction of development recognized through a magnifier of 10 magnification.

The result is summarized in Table 3.

TABLE 3

| Sample No. | Developer No. | Color Difference | | Definition (lines/mm) | |
|---|---|---|---|---|---|
| | | Initial | 100,000th | Initial | 100,000th |
| 1 | 1 | 1 | 2 | 7 | 7 |
| 2 | 2 | 1 | 3 | 7 | 7 |
| 3 | 3 | 1 | 3 | 7 | 7 |
| 4 | 4 | 2 | 4 | 7 | 6 |
| 5 | 7 | 1 | 2 | 7 | 7 |
| 6 | 9 | 2 | 2 | 7 | 7 |
| 7 | 10 | 3 | 5 | 7 | 6 |
| 8 | 12 | 1 | 1 | 7 | 7 |
| 9 | 13 | 2 | 3 | 7 | 7 |
| 10 | 14 | 2 | 3 | 7 | 7 |
| 11 | 5 | 4 | 8 | 6 | 5 |
| 12 | 6 | 5 | 9 | 5 | 3 |
| 13 | 8 | 4 | 8 | 6 | 4 |
| 14 | 11 | 5 | 8 | 6 | 5 |
| 15 | 15 | 5 | 9 | 6 | 4 |

Samples from 1 to 10 show low color difference and good image definition in both of initial and 100,000th copy.

What is claimed is:

1. An image forming method comprising the steps of forming a latent image on a static image carrier an image carrying member, developing the statie latent image by a developer containing a toner to form a toner image, the toner having a variation coefficient of the shape coefficient of not more than 16% and a number variation coefficient of the particle diameter distribution in number of not more than 27%, transferring the toner image onto an image carrier, the image carrier comprising an electrode contacting to the interior surface thereof, transferring the toner image onto an image forming support, and fixing the toner image transferred on the image forming support.

2. The image forming method of claim 1, wherein the image carrier has a cylindrical shape.

3. The image forming method of claim 2, wherein the toner has a ratio of toner particles each having a shape coefficient of from 1.2 to 1.6 of not less than 65% in number.

4. The image forming method of claim 2, wherein the toner has a content of toner particles without corner of not less than 50%.

5. The image forming method of claim 2, wherein number average particle diameter of the toner is 3 to 8 $\mu$m.

6. The image forming method of claim 2, wherein the toner exhibits at least 70 percent of the sum (M) of the relative freciuency ($m_1$) of toner particles included in the highest frequency class, and the relative frequency ($m_2$) of toner particles included in the second highest frequency class, in a number based histogram, in which natural logarithm 1nD is taken as the abscissa and said abscissa is divided into a plurality of classes at an interval of 0.23, wherein D is diameter of toner particles.

7. The image forming method of claim 1, wherein each of the image carrier has a volume resistivity of not less than $10^7$ Ωcm.

8. The image forming method of claim 1, wherein the electrode has a shape of shaft or blade.

9. An image forming method comprising developing latent images on image carrying members with toners, at least one of the toners having a variation coefficient of the shape coefficient of not more than 16% and a number variation coefficient of the particle diameter distribution in number of not more than 27% transferring the toner images to a first image carrier, transferring the toner images formed on the first image carrier onto a second image carrier, and transferring the transferred image on the second image carrier onto an image forming support.

10. The image forming method of claim 9, wherein each of the toners has a ratio of toner particles each having a shape coefficient of from 1.2 to 1.6 of not less than 65% in number.

11. The image forming method of claim 9, wherein each of the toners has a content of toner particles without corner of not less than 50%.

12. The image forming method of claim 9, wherein number average particle diameter of each of the toners is 3 to 8 $\mu$m.

13. The image forming method of claim 9, wherein each of the toners exhibits at least 70 percent of the sum (M) of the relative frequency ($m_1$) of toner particles included in the highest frequency class, and the relative frequency ($m_2$) of toner particles included in the second highest frequency class, in a number based histogram, in which natural logarithm 1 nD is taken as the abscissa and said abscissa is divided into a plurality of classes at an interval of 0.23, wherein D is diameter of toner particles.

14. The image forming method of claim 9, wherein each of the first and the second image carriers has a cylindrical shape.

15. An image forming method comprising:

developing a first latent image on a first latent image carrying member by a first developer containing a first toner to form a first toner image, the first toner including toner particles having no corner in a ratio of not less than 50% and a number variation coefficient of the particles diameter distribution in number being not more than 27%, transferring the first toner image onto a first image carrier having an electrode contacting to the interior surface thereof, and transferring the first toner image onto an image forming support.

16. The image forming method of claim 15, further comprising developing a second latent image on a second image carrying member with a second developer containing a second toner to form a second toner image and transferring the first toner image on the first image carrier and the second toner image onto a third image carrier, and wherein all the toner images on the third image carrier are transferred onto the image forming support.

17. The image forming method of claim 16, wherein the second toner contains toner particles having no corner in a ratio of not less than 50% and a number variation coefficient of the particles diameter distribution in number being not more than 27%.

18. The image forming method of claim 16, wherein the second toner has a variation coefficient of the shape coefficient of not more than 16% and a number variation coefficient of the particle diameter distribution in number of not more than 27%.

19. The method of claim 16, wherein the second toner has a ratio of toner particles each having a shape coefficient of from 1.2 to 1.6 of not less than 65% in number and a variation coefficient of the shape coefficient of not more than 16%.

20. The image forming method of claim 16, wherein each of the first, the second and the third image carriers has a cylindrical shape.

21. The image forming method of claim 20, wherein each of the first, the second and the third image carriers has a volume resistivity of not less than $10^7$ Ωcm, and each of the second and the third image carriers has an electrode.

22. The image forming method of claim 21, wherein the electrodes of the first, the second and the third image carriers are positioned around where a surface of any one of the image carriers are closest to the surface of any one of another image carriers.

23. An image forming method comprising developing a first latent image on a first image carrying member by a first developer containing a first toner to form a first toner image, the first toner having a ratio of toner particles each having a shape coefficient of from 1.2 to 1.6 of not less than 65% in number and a variation coefficient of the shape coefficient of not more than 16%, transferring the first toner image onto a first image carrier, the first image carrier including an electrode contacting to the interior surface thereof and, transferring the first toner image onto an image forming support.

24. The image forming method of claim 23, further comprising developing a second latent image on a second image carrying member with a second developer containing a second toner to form a second toner image onto a second image carrier and transferring the first toner image on the first image carrier and the second toner images on the second image carrier onto a third image carrier, and transferring all the toner images over the third image carrier onto an image forming support.

25. The image forming method of claim 24, wherein the second toner has a ratio of toner particles each having a shape coefficient of from 1.2 to 1.6 of not less than 65% in number and a variation coefficient of the shape coefficient of not more than 16%.

26. The image forming method of claim 25, wherein each of the first, the second and the third image carriers has a cylindrical shape.

27. The image forming method of claim 26, wherein each of the first, the second and the third image carriers has a volume resistivity of not less than $10^7$ Ωcm, and each of the second and the third image carriers has an electrode.

28. The image forming method of claim 27, wherein the electrodes of the first, the second and the third image carriers are positioned around where a surface of any one of the image carriers are closest to that of the any one of another image carriers.

* * * * *

UNITED STATES PATENT AND TRADEMARK OFFICE

CERTIFICATE OF CORRECTION

PATENT NO. : 6,703,177 B2 
DATED : March 9, 2004
INVENTOR(S) : Hiroshi Yamazaki and Ken Ohmura It is certified that error appears in the above-identified patent and that said Letters Patent is hereby corrected as shown below:

Column 33,
Line 3, change "on a static image carrier an image" to -- on an image carrier --.
Line 5, delete the word "statie".

Signed and Sealed this

Seventeenth Day of August, 2004

JON W. DUDAS
*Acting Director of the United States Patent and Trademark Office*